US007669540B2

(12) United States Patent
Dobrescu et al.

(10) Patent No.: US 7,669,540 B2
(45) Date of Patent: Mar. 2, 2010

(54) SOFT GOODS SLITTER AND FEED SYSTEM FOR QUILTING

(75) Inventors: Alex Dobrescu, Hollywood, FL (US); Terrance L. Myers, Carl Junction, MO (US)

(73) Assignee: L&P Property Management Company, South Gate, CA (US)

( * ) Notice: Subject to any disclaimer, the term of this patent is extended or adjusted under 35 U.S.C. 154(b) by 228 days.

(21) Appl. No.: 11/965,006

(22) Filed: Dec. 27, 2007

(65) Prior Publication Data

US 2008/0264222 A1 Oct. 30, 2008

Related U.S. Application Data

(63) Continuation-in-part of application No. 11/739,736, filed on Apr. 25, 2007.

(51) Int. Cl.
*D05B 27/10* (2006.01)
*D05B 69/00* (2006.01)
*D05B 11/00* (2006.01)

(52) U.S. Cl. ..... 112/475.08; 112/117; 112/320

(58) Field of Classification Search ..... 112/122, 112/122.3, 129, 303–307, 311, 318–320, 112/475.08, 117, 118; 83/23, 37, 176, 302, 83/500, 618, 155, 156; 271/8.1, 109; 74/380, 74/412 R See application file for complete search history.

(56) References Cited

U.S. PATENT DOCUMENTS

| | | | | |
|---|---|---|---|---|
| 285,896 | A | 10/1883 | Holland | |
| 2,803,206 | A | 8/1957 | Solow | |
| 3,143,024 | A | 8/1964 | Markowski | |
| 3,570,389 | A * | 3/1971 | Pontecorvo et al. | 99/455 |
| 3,630,801 | A * | 12/1971 | Booth | 156/197 |
| 3,682,032 | A | 8/1972 | Pfeiffer | |
| 3,684,140 | A * | 8/1972 | Voss | 225/2 |
| 3,835,716 | A * | 9/1974 | Bellamy | 74/40 |
| 3,869,999 | A | 3/1975 | Richter | |
| 4,033,251 | A * | 7/1977 | Thwaites et al. | 100/95 |
| 4,067,269 | A * | 1/1978 | Fanghanel | 112/2.1 |
| 4,462,530 | A * | 7/1984 | Block et al. | 226/156 |
| 4,594,955 | A | 6/1986 | Lichtenberg | |
| 4,954,202 | A * | 9/1990 | Price et al. | 156/353 |
| 5,154,130 | A | 10/1992 | Gribetz et al. | |
| 5,544,599 | A | 8/1996 | Frazer et al. | |
| 6,029,957 | A | 2/2000 | Zysman | |
| 6,082,277 | A * | 7/2000 | Block et al. | 112/2.1 |
| 6,237,517 | B1 | 5/2001 | Bondanza et al. | |
| 6,408,773 | B2 * | 6/2002 | Resta | 112/2.1 |
| 6,467,386 | B1 * | 10/2002 | Denney | 83/874 |
| 6,736,078 | B2 | 5/2004 | Kaetterhenry et al. | |
| 2006/0213417 | A1 * | 9/2006 | Codos et al. | 112/475.08 |

* cited by examiner

*Primary Examiner*—Ismael Izaguirre
(74) *Attorney, Agent, or Firm*—Wood, Herron & Evans, LLP

(57) ABSTRACT

An apparatus is provided for feeding and slitting mattress covers, quilts and other soft goods supported on a table. The apparatus has a first slitting wheel rotatable by a motor. A second slitting wheel is rotatable by the motor and contacts the first slitting wheel to provide a cutting action. The apparatus further includes a conveyor operable by the motor for conveying the soft goods past the slitting wheels, and a compression assembly having an actuator, a gear housing, and powered wheels for compressing the soft goods and holding the soft goods against the conveyor to preventing slippage or twisting.

21 Claims, 13 Drawing Sheets

SOFT GOODS SLITTER AND FEED SYSTEM FOR QUILTING

CROSS-REFERENCE TO RELATED APPLICATIONS

This application is a continuation-in-part application of U.S. patent application Ser. No. 11/739,736 filed Apr. 25, 2007 entitled "Soft Goods Slitter and Feed System for Quilting", which is fully incorporated by reference herein.

FIELD OF THE INVENTION

This invention relates generally to cutting soft goods and more particularly, to feeding and cutting a stack comprised of different layers of soft goods. The invention is particularly useful for trimming the longitudinal edges of mattress covers and other quilted soft goods in large-scale, wide-width sizes.

BACKGROUND OF THE INVENTION

In the manufacture of bedding and furniture, a mattress cover or other cushion is often fabricated from layers of different soft goods. Such mattress covers are typically made on wide-width multi-needle quilting machines and associated panel cutters such as those described in U.S. Pat. Nos. 5,154,130; 5,544,599; and, 6,237,517, all hereby expressly incorporated by reference herein.

For example, a mattress cover is often comprised of a stack of layers of different soft goods, which are often quilted together, that include a first, top layer of fabric ticking material, a second layer of a fiber material, a third layer of foam and a bottom layer of fabric backing material. Such a stack of compressible soft goods is about 2-6 inches thick and has a length and width corresponding to the size of the mattress cover being made. As part of the manufacturing process, it is necessary that the edges of the stack of soft goods be trimmed, so that the edges are straight and parallel. Known edge cutting machines have a motor-driven conveyor belt that transfers the stack of soft goods past a motor-driven compression roller and a pair of motor-driven cutting wheels. The compression roller compresses the stack of soft goods to a thickness of less than about three inches. A motor-driven cutting wheel is located on each side of the machine, and the cutting wheels must have a radius greater than the thickness of the compressed stack of soft goods, that is, at least about three inches.

While such a cutting operation is effective, it does have some disadvantages. First, the cutting wheel is relatively thin and has a tendency to bend or warp slightly from the cutting forces applied by the compressed stack of soft goods being moved past the cutting wheel by the conveyor. Thus, the cutting wheel has a tendency to drift or walk with respect to a desired straight cutting path, thereby producing a cut edge of the stack of soft goods that is rough and not straight over the length of the stack.

Second, the cutting wheel edge dulls with use and must be periodically sharpened. Therefore, a separate sharpening device is mounted adjacent the cutting wheel. In order to effect a sharpening cycle, the edge cutting operation is interrupted; and the sharpening device is manually or automatically moved into contact with the cutting wheel to execute a cutting wheel sharpening cycle. During the sharpening cycle, the cutting machine is out of production; and thus, the sharpening cycle reduces the efficiency of the machine operation and adds to the overall cost of the cutting operation.

In addition, the overall structure of the cutting machine is relatively complicated and costly. The cutting machine requires a motor-driven compression roller as well as a relatively wide motor-driven conveyor belt that provides a subjacent support for the stack of soft goods and moves it past the cutting wheel. A sharpener is also required, which has actuators that move the sharpener into contact with the cutting wheel; and often, a separate clamp is used. Such a system has different motors or actuators for powering the cutting wheel, the compression roller, the conveyor and for positioning the cutting wheel sharpener. Further, the operation of those actuators is often coordinated by a separate control. Such a complex cutting machine is expensive to build, operate and maintain; and that expense must be borne by the product, for example, the mattress cover, being trimmed on the cutting machine. This is particularly relevant to quilt manufacture.

U.S. Pat. No. 6,736,078, which is fully incorporated by reference herein, discloses an apparatus that included a variety of improvements to overcome these drawbacks. The patented apparatus includes a pair of powered conveyors, the upper conveyor including a system of links and springs within the upper conveyor. The upper conveyor functions to compress the soft goods and propel them through the machine. Each upper conveyor is tapered or sloped at its leading or upstream end. Consequently, the material or soft goods may roll back on itself as it is cut and propelled forward by the upper conveyors. Because of this issue, under some conditions, "dog earring" in the corners of the resultant cut panels may occur.

Therefore, there is a need for a cutting machine that reliably provides a clean and straight cut edge over the full length of the stack of soft goods, has a simpler and less costly structure, does not have material roll back and eliminates or reduces "dog earring" in the cut panel corners. This need especially exists in the manufacture of quilts such as quilted mattress covers, that are manufactured on a large-scale.

SUMMARY OF THE INVENTION

The present invention provides a relatively compact and inexpensive slitter and feed mechanism that reliably feeds, compresses and cuts side edges of a quilt or other stack of soft goods.

The slitter and feed mechanism achieves the feeding, compression and cutting actions with just a single motor on each side of the apparatus. The use of only one motor represents a substantial cost savings over known feeding, compressing and cutting devices. A quilting panel cutter equipped with such a slitter and feed mechanism improves the quality and economy of the quilt making process.

The slitter and feed mechanism further permits the compression force to be easily adjusted. The cutting edges of the slitting wheels are preloaded to more reliably hold the cutting edges in contact, so that a clean and consistent cutting action is provided. As a result, in a quilt manufacturing operation, quilts of differing thicknesses can be trimmed without the need for prolonged shutdown and adjustment of the quilting line.

In addition, with the slitter and feed mechanism of the present invention, the slitting wheels are mounted to be self-sharpening during use, thereby providing a more reliable cutting action over an extended period of time. Thus, the slitting process is more efficient because the machine does not have to be taken out of production to sharpen the slitting wheels. The slitter and feed mechanism of the present invention is especially useful in the textile industry for trimming a quilt or other stack of soft goods as is found, for example, in a cushion or mattress cover.

The invention provides an apparatus for feeding and slitting soft goods such as a mattress cover or other quilt being supported on a table. The apparatus has a motor mounted on a frame and a first slitting wheel rotatable by the motor. A second slitting wheel is rotatable by the motor and contacts the first slitting wheel to provide a cutting action. Thus, both of the slitting wheels are rotatable by a single motor.

The apparatus further includes a conveying apparatus for conveying the soft goods past the slitting wheels; and the conveying apparatus is operably connected to the motor. Thus, the single motor not only operates the slitting wheels but also operates the conveying apparatus.

In another aspect of the invention, an apparatus for slitting and feeding soft goods includes first and second slitting wheels that are rotatable by a motor. A biasing apparatus is mechanically connected to the first slitting wheel and biases the first slitting wheel against the second slitting wheel with a desired biasing force. Such a biasing forces maintains the first and second slitting wheels in contact during a cutting operation.

In a further aspect of the invention, an apparatus for slitting and feeding soft goods includes first and second slitting wheels that are rotatable by a motor about respective first and second axes of rotation. The second axis of rotation is oblique to the first axis of rotation by an amount that results in a self-sharpening of the slitting wheels. In one aspect of the invention, the oblique axes of motion form an acute angle therebetween of about 2°. The oblique axes of rotation plus the slitting wheel biasing force provides a self-sharpening capability that substantially improves the durability, quality and reliability of the cutting action of the slitting wheels.

In another aspect of the invention, an apparatus for slitting and feeding soft goods includes first and second powered slitting wheels that are rotatable by a motor and rotatably supported by a frame adapted to be mounted adjacent one side of a table. The second powered slitting wheel contacts the first slitting wheel to provide a cutting action. A powered conveyor adapted to be positioned adjacent the table comprises a conveyor belt adapted to contact and support a lower surface along an edge of the soft goods. A compression assembly is disposed above the conveyor and is adapted to contact an upper surface along the same edge of the soft goods. The compression assembly comprises a swing arm pivotally connected to the frame about a pivot axis, at least one roller connected to the swing arm and an actuator, for example an air cylinder, operatively coupled to the swing arm for applying a compressive force through the roller or rollers to the soft goods. The at least one roller is resiliently movable in a generally vertical direction with respect to the conveyor. In one embodiment, the compression assembly comprises a pair of side-by-side upstream rollers which are free spinning and a downstream roller having the same axis of rotation as the pivot axis of the swing arm. In this embodiment, the actuator is operatively coupled to the swing arm between the downstream roller and the upstream rollers. The actuator and the swing arm are pivotally connected to the frame. The actuator is controlled to raise and lower the swing arm upon command. The motor or driver powers the first and second slitting wheels along with the conveyor through a series of gear trains.

The compression force is adjustable and all or some of the rollers of the compression assembly can be raised and lowered on command to accommodate different activities in the cycle of the machine. An example of using this raising and lowering is to raise the upstream rollers of the compression assembly when the leading edge of a piece of material or group of soft goods enters the machine, and then lower these rollers when needed to compress and/or hold the material or soft goods during feeding, slitting, or crosscutting. The same motor that powers the slitter can also be used to power the conveyor.

The apparatus for feeding and slitting compressible soft goods has a stationary table for supporting the soft goods. A rail is disposed above, and extends across a width of, the stationary table. First and second slitter and feed mechanisms are mounted on the rail adjacent side edges of the table. The slitter and feed mechanisms are movable across the width of the table. A first actuator is mounted on the rail and has a reciprocal drive shaft pivotally connected to the first slitter and feed mechanism, and a second actuator is mounted on the rail and has a reciprocal drive shaft pivotally connected to the second slitter and feed mechanism. Thus, the separation of the slitter and feed mechanisms can be controlled to trim different widths of soft goods by using these actuators to position the slitter and feed mechanisms along the cross rail.

An alternative embodiment comprises an apparatus for feeding and slitting a stack of compressible soft goods being supported on an upper surface of a table. This embodiment comprises a frame adapted to be mounted adjacent a table, a motor, a first powered slitting wheel rotatably driven by an input shaft or spindle rotatable by the motor and a second powered slitting wheel rotatably driven by the motor and contacting the first slitting wheel to provide a cutting action. A powered conveyor is driven by the motor and adapted to be positioned adjacent the table. The powered conveyor comprises a conveyor belt adapted to contact and support a lower surface along an edge of soft goods.

The apparatus for feeding and slitting a stack of compressible soft goods further comprises a compression assembly disposed above the conveyor adapted to contact an upper surface along an edge of the soft goods. The compression assembly comprises an actuator operatively coupled to the frame, a gear housing operatively coupled to the actuator, gears inside the gear housing, an input gear of the gears being rotatable by the input shaft and rollers for contacting an upper surface of the soft goods and moving the soft goods. The rollers are operatively coupled to an output gear inside the gear housing. The rollers are driven by a drive shaft rotatable by the output gear.

The apparatus for feeding and slitting a stack of compressible soft goods being supported on an upper surface of a table may be described as comprising a frame adapted to be mounted adjacent one side of a table, a motor supported by the frame for driving an input shaft, a first powered slitting wheel rotatably driven by the input shaft and a second powered slitting wheel rotatably driven by an output shaft, the output shaft being driven by a gear train powered by the motor, the second powered slitting wheel contacting the first slitting wheel to provide a cutting action. A powered conveyor is adapted to be positioned adjacent the table and comprising a conveyor belt adapted to contact and support a lower surface along an edge of soft goods. The compression assembly is as described herein.

The apparatus for feeding and slitting a stack of compressible soft goods being supported on an upper surface of a table may be described as comprising a frame adapted to be mounted adjacent one side of a table, a motor, a first powered slitting wheel powered by the motor and rotatably supported by the frame and a second powered slitting wheel powered by the motor and rotatably supported by the frame, the second powered slitting wheel contacting the first slitting wheel to provide a cutting action. A conveyor is powered by the motor and supported by the frame, the conveyor adapted to be positioned adjacent the table and comprising a conveyor belt adapted to contact and support a lower surface along an edge of soft goods.

The compression assembly is movable between a raised and lowered position, the compression assembly being disposed above the conveyor and adapted to contact an upper surface along the edge of the soft goods. The compression assembly comprises an actuator, a gear housing operatively coupled to the actuator, gears inside the gear housing, one of the gears being rotatable by the input shaft and operatively coupled to another gear for rotating rollers adapted to contact an upper surface of the soft goods and move the soft goods downstream.

The apparatus for feeding and slitting compressible soft goods may be described as comprising a stationary table having an upper surface adapted to support the soft goods; a rail mounted above the stationary table and extending across a width of the stationary table; a first slitter and feed mechanism mounted for sliding motion adjacent one end of the rail; a first actuator supported by the rail having a reciprocal drive shaft pivotally connected to the first slitter and feed mechanism; a second slitter and feed mechanism mounted for sliding motion adjacent an opposite end of the rail; a second actuator supported by the rail and having a reciprocal drive shaft pivotally connected to the second slitter and feed mechanism, the first and second actuators being operable to move respective first and second slitter and feed mechanisms to different positions along the rail. The first and second slitter and feed mechanisms each further comprise: a frame adapted to be mounted adjacent one side of the stationary table, a powered conveyor adapted to be positioned adjacent the stationary table, and a compression assembly disposed above the conveyor and adapted to contact an upper surface along the edge of the compressible soft goods. The compression assembly comprises an actuator pivotally connected to the frame, a gear housing connected to the actuator and at least one roller driven by a shaft rotatable by one of the gears inside the gear housing.

The apparatus for feeding and slitting compressible soft goods may be used to practice a method of making quilted panels. This method comprises quilting multi-layered soft goods at a quilting station and feeding the quilted soft goods to a cutting apparatus The method further comprises, at the cutting apparatus, supporting the quilted soft goods on a table having a frame, a motor mounted on the frame, a first slitting wheel powered by the motor and rotatably supported by the frame, a second slitting wheel powered by the motor and rotatably supported by the frame and contacting the first slitting wheel to provide a cutting action, a conveyor powered by the motor and supported by the frame, the conveyor adapted to be positioned adjacent the table and comprising a conveyor belt adapted to contact and support a lower surface along an edge of the soft goods; and a compression assembly disposed above the conveyor and adapted to contact an upper surface along the edge of the soft goods, the compression assembly comprising an actuator operatively coupled to the frame, a gear housing operatively coupled to the actuator, gears inside the gear housing, an input gear of the gears being rotatable by the input shaft and rollers for contacting an upper surface of the soft goods and moving the soft goods, the rollers being operatively coupled to an output gear inside the gear housing. The method further comprises energizing the motor to operate the cutting apparatus to feed the quilted soft goods over the table and to slit the opposite edges from the quilted soft goods.

These and other objects and advantages of the present invention will become more readily apparent during the following detailed description taken in conjunction with the drawings herein.

DETAILED DESCRIPTION OF THE INVENTION

Figure 1:
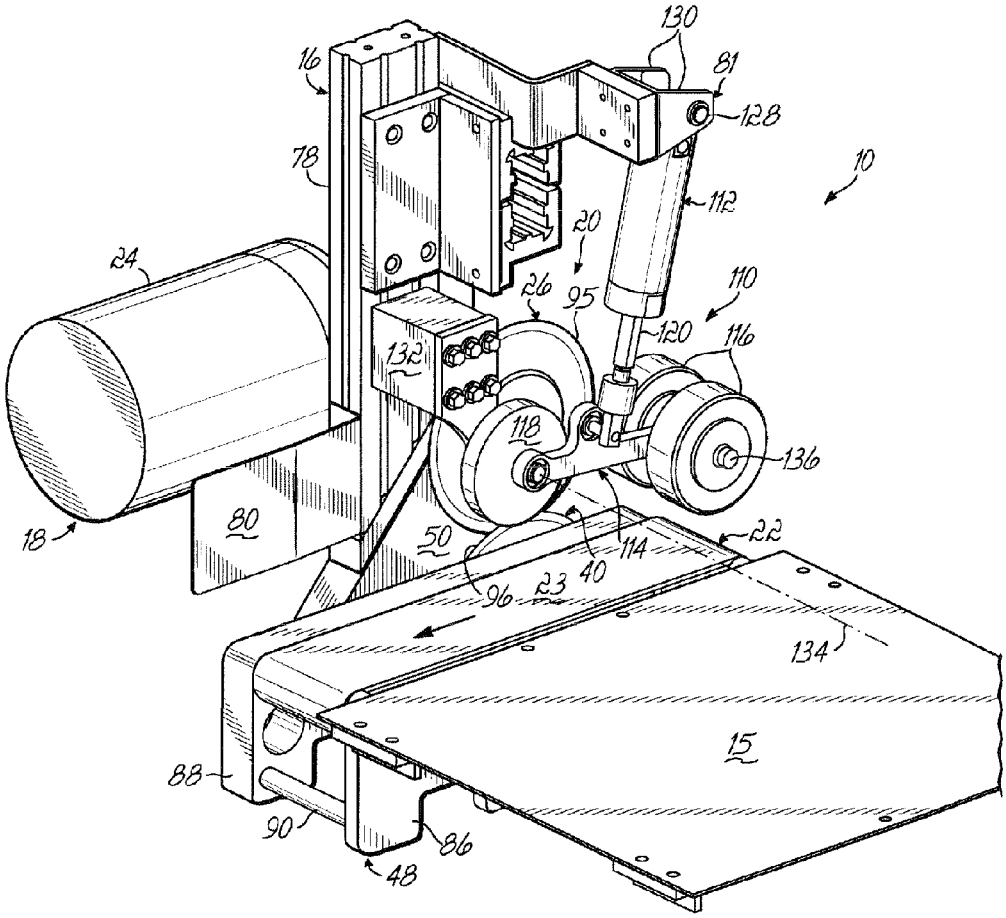
FIG. 1 is a perspective view of a slitter and feeder mechanism in accordance with the principles of the present invention, which is used to trim one edge of soft goods.
Figure 5:
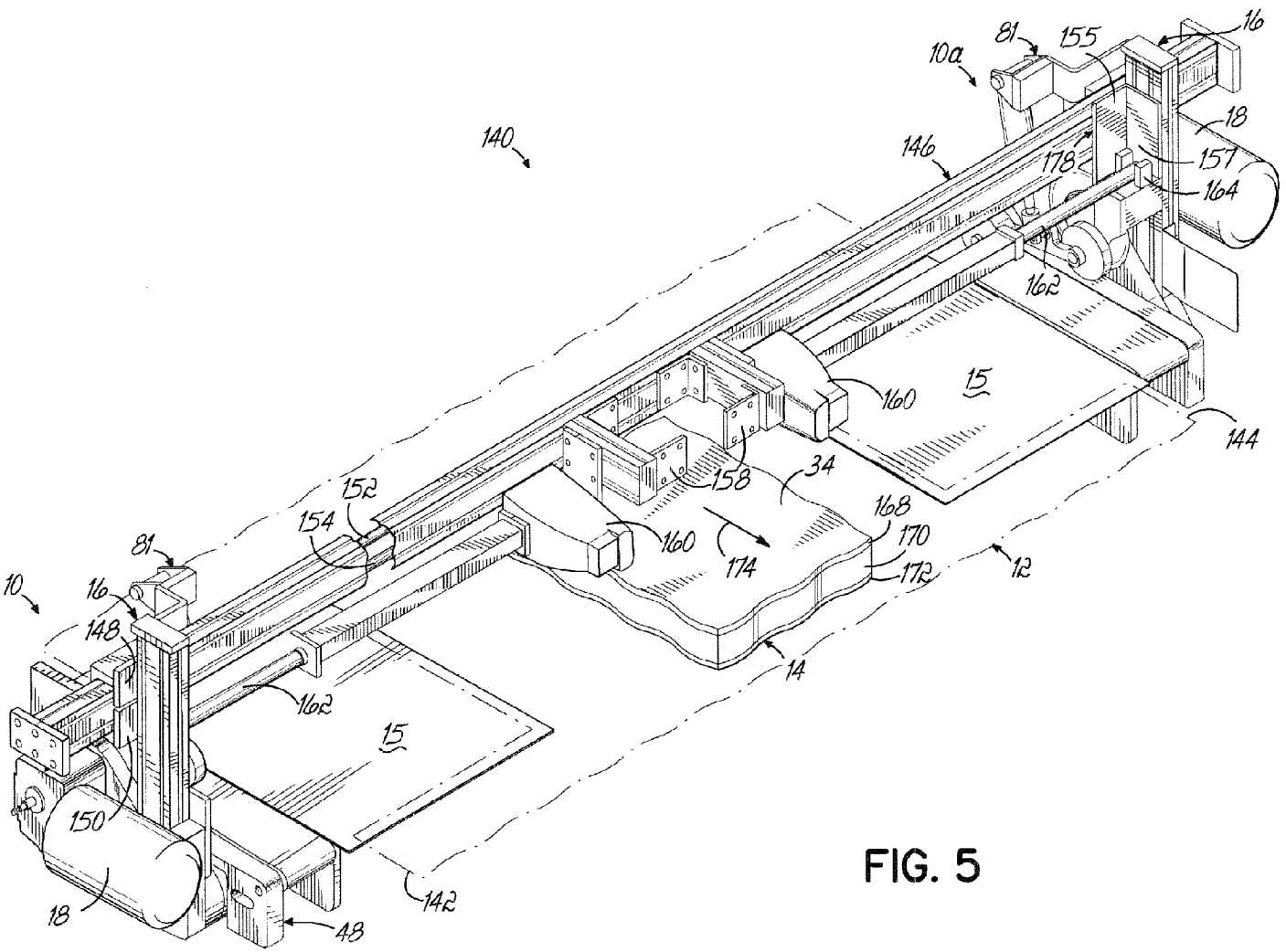
FIG. 5 is a partial perspective view of a machine that uses the slitter and feed mechanism of FIGS. 1-4.
Figure 6A:
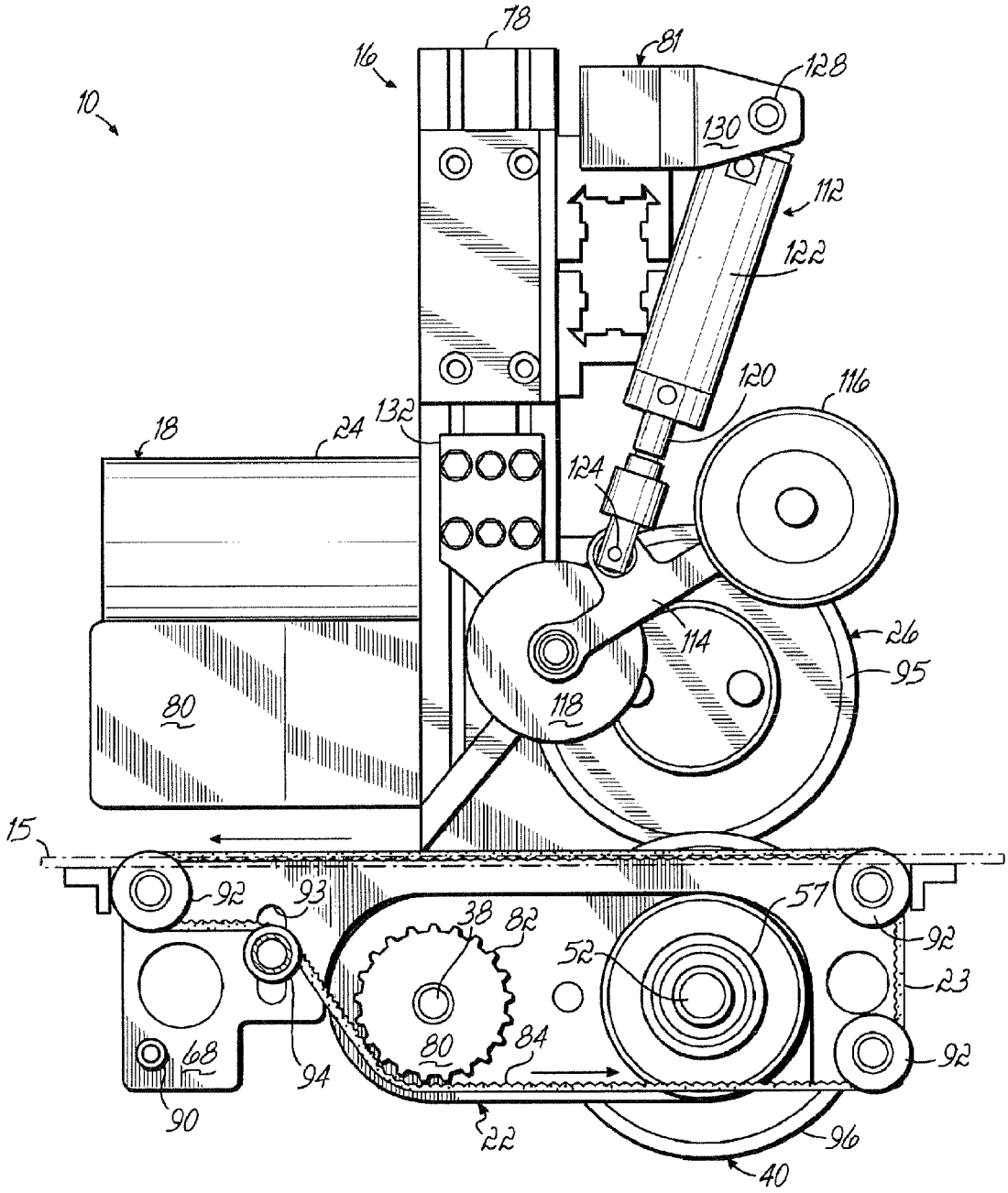
FIG. 6A is a front elevation view of the slitter and feed mechanism of FIG. 1 illustrating the compression assembly in a raised position before or after soft goods as passed under the compression assembly.
Figure 6B:
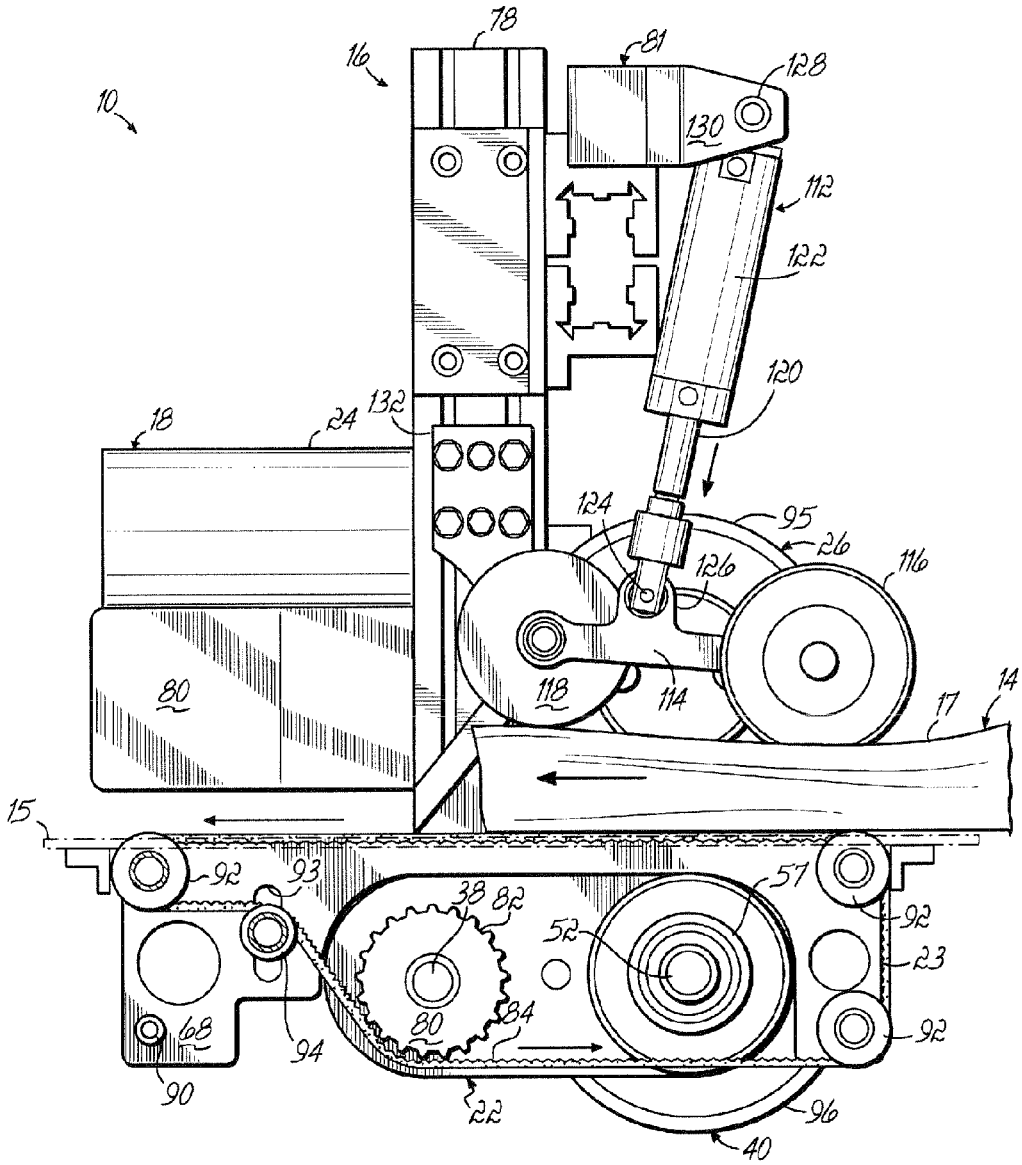
FIG. 6B is a front elevation view of the slitter and feed mechanism of FIG. 1 illustrating a resilient deflection of the compression assembly as soft goods are fed thereby.

Referring to FIG. 1, a slitter and feed mechanism or apparatus 10 is mounted on one side of a table 12 (see FIG. 5) and is used to trim one edge of soft goods 14. A conveyor(s) or any other mechanism (not shown) may be used to move the soft goods 14 as shown in FIGS. 5 and 6B past the slitter and feed mechanisms 10 and 10*a* onto table 12 (from left to right in FIG. 5).

Referring to FIG. 1, the slitter and feed mechanism 10 comprises a support frame 16, a power supply or driver 18, for example, an electric motor, a slitter 20 comprising first and second powered slitting wheels 26, 40, a conveyor 22 rotatable about a movable housing 48 and driven by the motor 18, a support plate 15 mounted to the housing 48 and a compression assembly 110 movable relative to the support frame 16. The motor 18 and gearbox 24 are packaged together as a ⅓ horsepower, 67 rpm, face-mount, gear motor, Part No.

#HMQ-520-26-H5616+1011769, commercially available from Leeson Electric of Grafton, Wis. Referring to FIGS. 6A and 6B, the slitter and feed mechanism 10 is used to trim an edge of soft goods 14. As shown in FIG. 5, there is a second slitter and feed mechanism 10*a* which is a mirror image of, but otherwise identical to, the slitter and feed mechanism 10.

Figure 2:
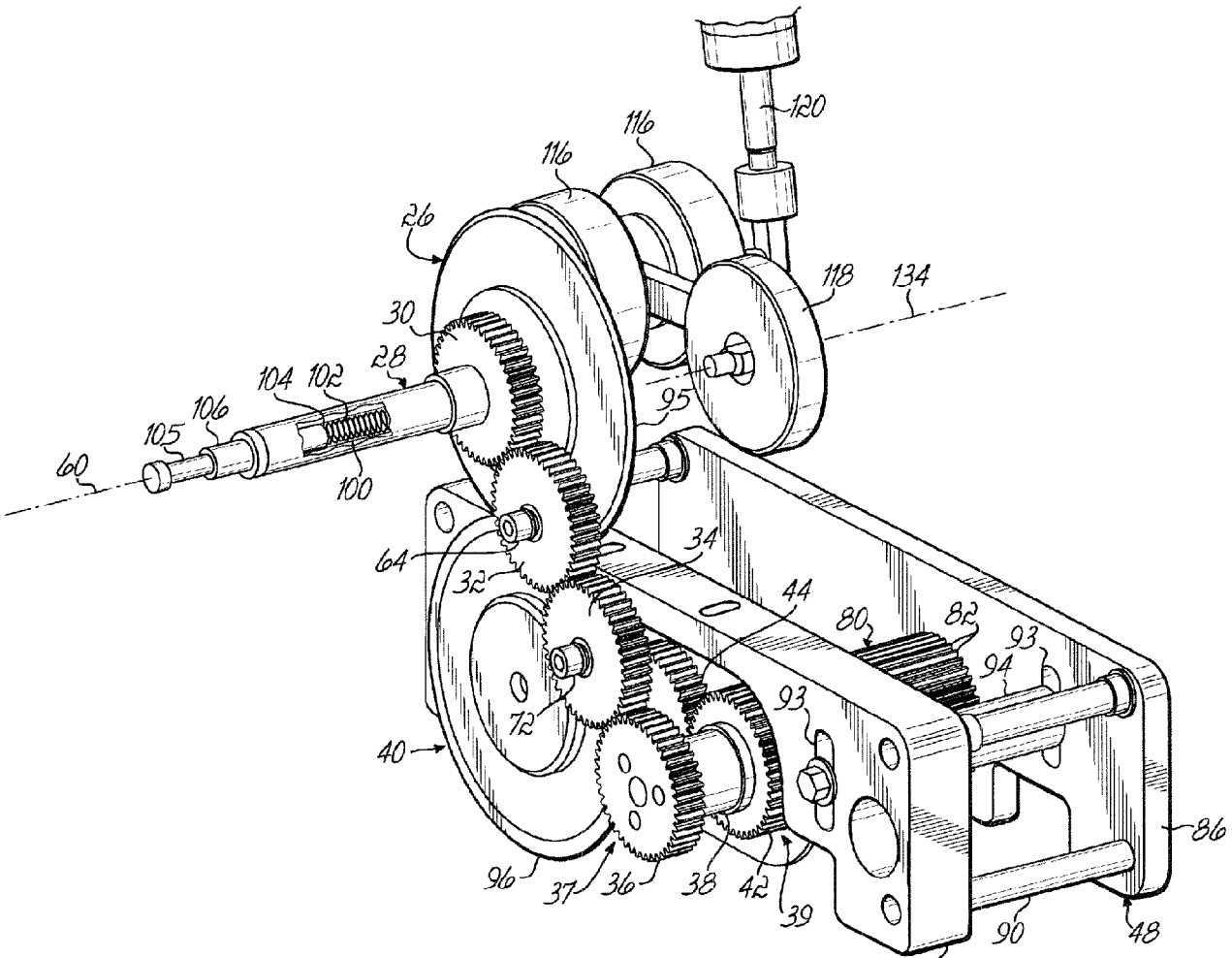
FIG. 2 is a partial perspective view of a slitter wheel power drive for the slitter and feed mechanism shown in FIG. 1.
Figure 2A:
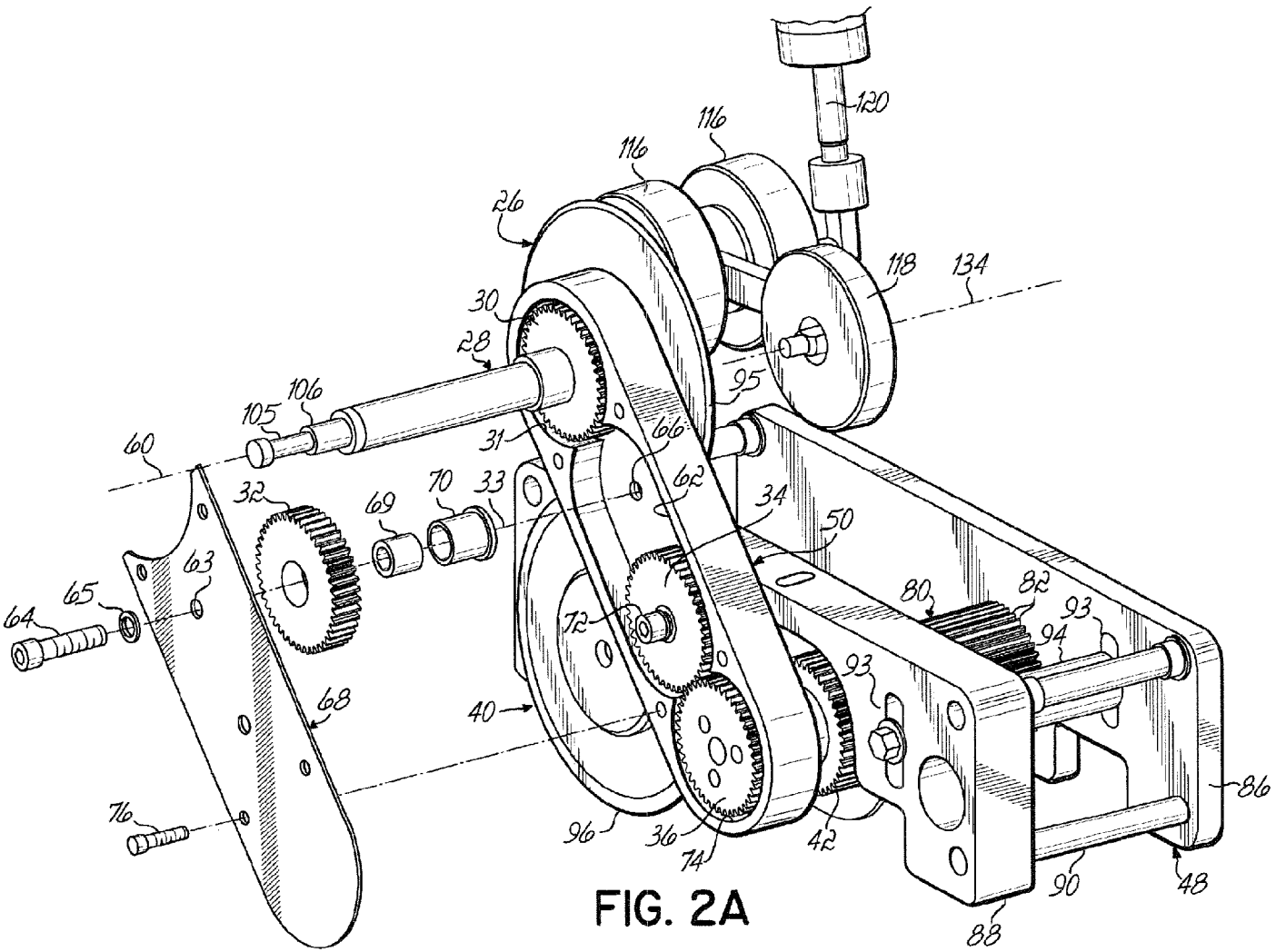
FIG. 2A is a partial perspective view of a slitter wheel power drive for the slitter and feed mechanism shown in FIG. 1 illustrating part of the mechanism disassembled.

As shown in FIG. 2, the slitter 20 comprises an upper cutting or slitting wheel 26 mounted on one end of an input spindle or shaft 28. The opposite end of the input spindle 28 has a keyway (not shown), so that it can be axially engaged in a drive shaft (not shown) in the gear box 24 (FIG. 1) in a known manner. As shown in FIGS. 2 and 2A, a first gear 30 is rigidly mounted on the input spindle 28 and located in a receptacle 31 in a housing 50. This first gear 30 engages a second gear 32 which rotates about axis 33. As shown in FIG. 2A, a threaded fastener 64 passes through a hole 63 in a cover plate 68, through second gear 32, through a sleeve 69 and a bushing 70 and is engaged in a threaded hole 66 in housing 50. A washer 65 surrounds fastener 66 outside cover plate 68. The second gear 32 is located in another receptacle 62 in the housing 50 and drives a third gear 34 which is rotatably mounted inside the receptacle 62 in the housing 50 in the same manner as the second gear 32 with a fastener 72. As best shown in FIG. 2, the third gear 34 drives a fourth and lowermost gear 36 mounted on the end of a lower spindle 38. The fourth gear 36 is rotatable inside another receptacle 74 located at the bottom of housing 50. The cover plate 68 is mounted to the body of the housing 50 with fasteners 76 (only one being shown in FIG. 2A) and covers the receptacles 62 and 74 of housing 50. The upper receptacle 31 of housing 50 is covered by a portion of the motor 18 and gearbox 24 package described above rather than by cover plate 68.

These first, second, third and fourth gears 30, 32, 34 and 36, collectively, may be considered an outer set of gears or gear train 37 which drives or rotates the upper cutting or slitting wheel 26 along with the lower spindle 38. Rotation of the lower spindle 38 causes rotation of the lower cutting or slitting wheel 40 via an inner set of gears or gear train 39 comprising three gears 42, 44 and 46 as shown in FIG. 3.

The motor 18 drives the outer gear train 37 beginning with rotation of the first or upper gear 30 via input spindle 28. Rotation of the gears of the outer gear train 37 rotates the lower spindle 38 which is operatively coupled to a lower cutting or slitting wheel 40 via an inner set of gears or gear train 39. See FIG. 3. Rotation of the lower spindle 38 via the outer gear train 37 drives the inner gear train 39 which causes rotation of the lower cutting or slitting wheel 40 of the slitter 20.

Figure 3:
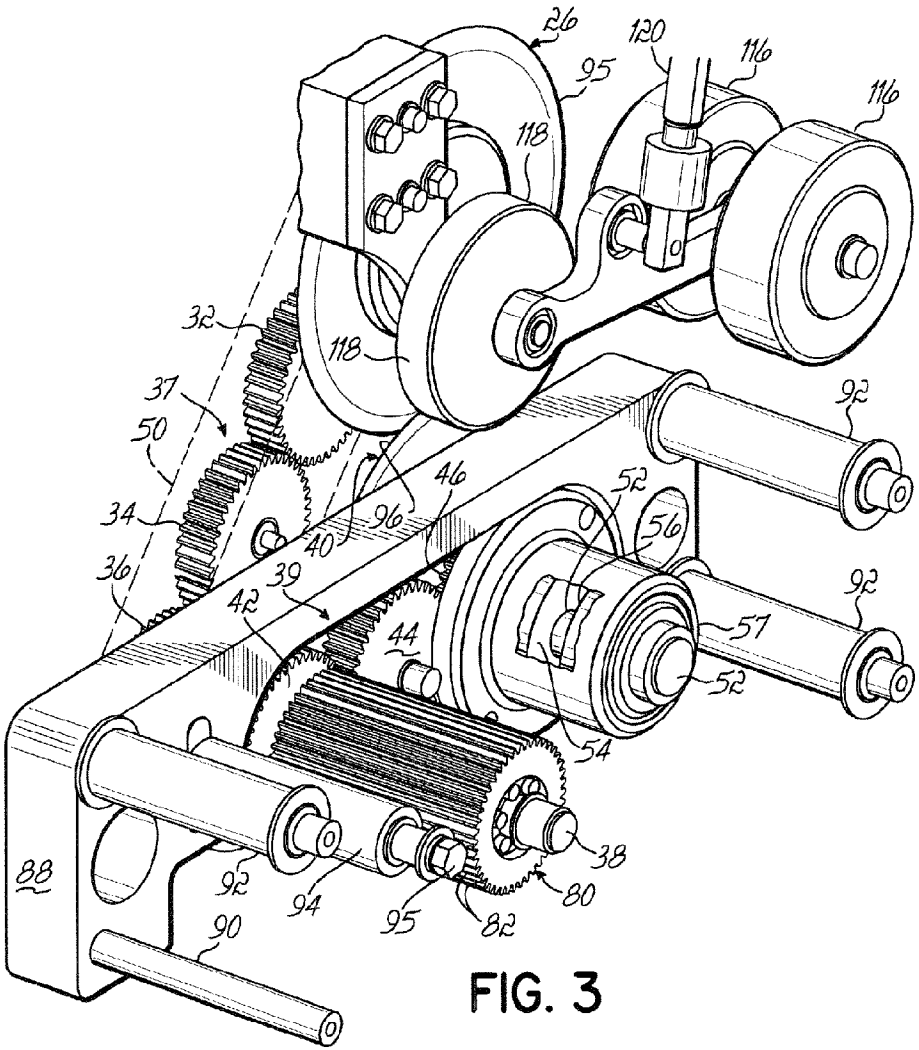
FIG. 3 is a partial perspective view of a conveyor drive of the slitter and feed mechanism shown in FIG. 1.

As shown in FIGS. 2 and 3, the inner set of gears or gear train 39 includes an upstream gear 42 mounted on lower spindle 38. Upstream gear 42 contacts middle gear 44 of the inner gear train 39 so that rotation of the upstream gear 42 caused by rotation of the lower spindle 38 causes rotation of the middle gear 44. Middle gear 44 contacts downstream gear 46 of the inner gear train 39 so that rotation of the middle gear 44 caused by rotation of the upstream gear 42 causes rotation of the downstream gear 46. The downstream gear 46 is mounted on an output spindle 52 as shown in FIG. 3. The slitting wheels 26, 40 are blade, scissor, small bevel slitting wheels commercially available from Gateway Textiles of Notts, England.

The outer gear train gears 30, 32, 34 and 36 are located in a housing 50 including a cover plate 68 configured to protect them from dirt and debris. The motor 18 and gear box 24 package (not shown) is mounted to the outer gear train housing 50 by fasteners or other means.

As seen in FIG. 1, the frame 16 includes an extrusion 78, a deflector plate 80 attached to the extrusion 78 and a generally U-shaped mounting bracket 81 all of which are operatively coupled or connected together by fasteners or other means. Although one configuration of frame 16 is illustrated any other support frame or portion there of may be used with the present invention. An upper portion of the compression assembly 110 is pivotally mounted to the mounting bracket 81 as described below.

As shown in FIGS. 2, 2A and 3, a drive sprocket 80 is mounted on lower spindle 38 at the end thereof inside housing 48. This drive sprocket 80 has outer teeth 82 which engage or contact a generally corrugated inner surface 84 of conveyor belt 23 to drive the conveyor belt 23 in a counterclockwise direction as seen in FIGS. 6A and 6B. Thus, rotation of the gears 30, 32, 34 and 36 of the outer gear train 37 caused by activation of the motor 18 cause the lower spindle 38 to rotate which in turn causes the drive sprocket 80 to rotate which drives the conveyor belt 23. Thus, the motor 18 drives the conveyor 22 along with both wheels 26, 40 of slitter 20.

As shown in FIGS. 2 and 2A, the drive sprocket 80 is located inside housing 48 and more particularly between an inner housing plate 86 and an outer housing plate 88. Although outer housing plate 88 is illustrated as being thicker than inner housing plate 86, the housing plates 86, 88 may be any desired configuration or thickness or material. The inner housing plate 86 is rigidly connected to an outer housing plate 88 by tie bars 90 that are fastened at their ends to the housing plates 86, 88. Although four tie bars 90 are illustrated, any number of bars or similar devices may be used to join the inner and outer housing plates. A support plate 15 is rigidly fastened to the inner housing plate 86 of housing 48 as shown in FIG. 1.

As best shown in FIG. 3, an idler pulley 92 surrounds three of the tie bars 90, two at the upstream end of the housing 48 and an upper one at the downstream end of the housing 48 so that the conveyor belt 23 driven by rotation of the drive sprocket 80 may travel without interruption or binding. As shown in FIGS. 6A and 6B, each of the inner and outer housing plates 86, 88, respectively, has a slot 93 therein in which rides a belt tensioner 94 for adjusting the tension on the conveyor belt 23 by turning nut 95. See FIG. 3. Of course, any other means of adjusting the tension of conveyor belt 23 may be used.

Through the drive trains 37, 39, the motor 18 provides power to the upper and lower slitting wheels 26, 40 of slitter 20. Further, the diameters of the gears 30, 32, 34, 36, 42, 44 and 46 are chosen such that the angular velocity of the upper slitting wheel 26 is substantially equal to the angular velocity of the lower slitting wheel 40.

As shown in FIG. 3, the output spindle 52 is supported by an outer bearing 54 and an inner bearing 56 that are mounted inside a bearing housing 57. Typically, the bearings 54, 56 are oriented such that the output spindle 52 has a lower axis of rotation 58 that is substantially parallel to an upper axis of rotation 60 of the input spindle 28. Therefore, referring to FIG. 4, looking down on the bearings 54, 56, with a typical mounting, the projection of the lower axis of rotation 58 onto a horizontal plane, for example, support plate 15 (FIG. 1), would be approximately collinear. Further, the parallel lower and upper axes of rotation 58, 60 would define a substantially vertical plane that is substantially perpendicular to the support plate 15. Therefore, the opposed and contacting cutting portions 95 and 96 of the respective upper and lower slitting wheels 26, 40 are substantially parallel, and the cutting portions 95, 96 have a small common area of contact.

Figure 4:
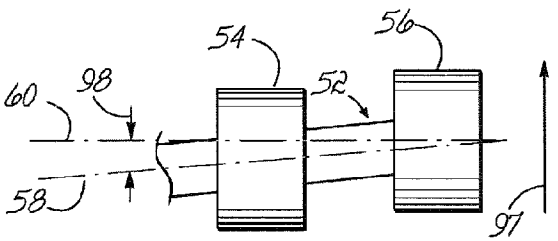
FIG. 4 is a top view of spindle bearings for one of the slitter wheels and illustrate an oblique relationship between axes of rotation of the slitting wheels used with the slitter and feed mechanism of FIG. 1.

However, in contrast to a typical mounting described above, with the present invention, as shown in FIG. 4, the inner bearing 56 is offset in a substantially horizontal plane in the direction indicated by the arrow 97, thereby making the output spindle 52 and corresponding lower axis of rotation 58 oblique to the input spindle 28 and corresponding upper axis of rotation 60. In other words, the output spindle 52 and corresponding lower axis or rotation 58 is pivoted in a plane parallel to the support plate 15 with respect to the input spindle 28 and corresponding upper axis of rotation 60 through an angular displacement 91 of about 2°. Thus, projections of the lower and upper axes of rotation 58, 60 into the plane of the support plate 15 form an included angle 98 between the projected lower and upper axes of rotation 58, 60 of about 2°. This small pivoting of the output spindle 52, its corresponding axis of rotation 58 and lower slitting wheel 40 angles or skews the lower slitting wheel 40 with respect to the upper slitting wheel 26. Thus, the cutting portions 95, 96 are not parallel, and the area of common contact between the cutting portions 95, 96 is substantially reduced.

Referring to FIG. 2, the input spindle 28 has a central axial bore 100 that contains a compression spring 102. The biasing compression spring 102 mechanically contacts an end 104 of an adjusting screw 105 that is threaded into a nut 106 that is mounted or secured in a wall of the gear box 24. Alternatively, the adjusting screw 105 can supported in a threaded hole in the wall of the gear box 24. The input spindle 28 is axially movable with respect to the gear box 24, and thus, the spring 102 is effective to provide an axial preload or biasing force on the input spindle 28. That biasing force preloads or pushes the upper slitting wheel 26 against the lower slitting wheel 40. Further, the magnitude of that preload force is adjustable by turning the adjusting screw 105. The application of the axial preload or force on the upper slitting wheel 26 guarantees that the upper cutting portion 95 of the upper slitting wheel 26 always remains in contact with the lower cutting portion 96 of the lower slitting wheel 40. Thus, the axial preload on the upper slitting wheel 26 substantially improves the cutting action of the upper and lower slitting wheels 26, 40. Further, the net effect of the axial preload provided by the biasing spring 102 combined with the small angular pivot of the output spindle 52 and lower slitting wheel 40 is to provide a dynamic and automatic self-sharpening of the cutting portions 95, 96 of the respective upper and lower slitting wheels 26, 40.

As shown in FIG. 3, the drive sprocket 80 drivingly engages conveyor belt 23 (FIG. 1) that is also supported by pairs of inner and outer idler pulleys 92 (FIG. 3). The idler pulleys 92 are rotatably supported by respective tie rods 90. Inner ends of the tie rods 90 are supported by the inner housing plate 86; and the outer ends of the tie rods 90 are supported by an outer housing plate 88 (FIG. 1). Thus, the conveyor belt 23 provides a fixed, generally horizontal surface that is substantially parallel to the surface of the support plate 15. The inner and outer housing plates 86, 88 are rigidly connected together by tie bars (not shown) that are fastened at their ends to the housing plates.

Referring to FIG. 1, the slitter and feed mechanism or apparatus 10 mounted on one side of table 12 further comprises a compression assembly 110 disposed above the conveyor 22 and adapted to contact an upper surface of soft goods 14 and provide a downward compressive force on the soft goods 14 in order to keep the soft goods 14 moving downstream via conveyors 22 and aligned correctly. The compression assembly 110 comprises an actuator 112 which is pivotally connected to frame 16 via mounting bracket 81, a swing arm 114 pivotally mounted to frame 16, a pair of free-spinning side-by-side upstream rollers 116 connected to the swing arm 114 and a downstream roller 118.

The compression assembly 110 is movable between a raised position shown in FIG. 6A and a lowered position shown in FIG. 6B. In its lowered position shown in FIG. 6B, the rollers 116, 118 of the compression assembly 110 contact an upper surface 17 of the soft goods 14 to provide a compressive force and help move the soft goods 14 downstream.

The actuator 112 of the compression assembly 110 comprises an air cylinder pressurized in a range of between approximately 20-25 psi. The actuator has a movable rod 120 which moves inside a cylinder 122. The rod 120 is pivotally joined to swing arm 114 at location 124 and more particularly to a bump 126 of the swing arm 114 located between the upstream rollers 116 and downstream roller 118. See FIG. 6B. At its upper end, the actuator 112 is pivotally connected to a rod 128 extending between two ears 130 of mounting bracket 81.

As shown in FIG. 1, the downstream end of the swing arm 114 is pivotally connected to a bracket 132 secured to frame 16 to pivot about a fixed pivot axis 134. Inside the bracket 132 is mounted downstream roller 118 which is rotatable about pivot axis 134 and does not move other than to rotate. At the other end of swing arm 114 the two side-by-side upstream rollers 116 are rotatably mounted on a rod 136 on opposite sides of the swing arm 114.

In use, referring to FIG. 5, a machine 140 for trimming the side edges of soft goods 14 has a first slitter and feed mechanism 10 mounted adjacent one edge 142 of a stationary table 12. A second slitter and feed mechanism 10*a* is mounted adjacent an opposite edge 144 of the stationary table 12. The slitter and feed mechanisms 10, 10*a* are mirror images of each other. Further, the extrusions 78 as well as the other parts of the support frames 16 are identical parts that are fabricated so that they may be used with either of the slitter and feed mechanisms 10, 10*a*. In addition, all of the other parts in the slitter and feed mechanisms 10, 10*a* are identical and interchangeable. Thus, the assembly of different, that is, mirror image, slitter and feed mechanisms 10, 10*a* is relatively cost efficient.

The extrusions 78 are supported by a cross rail 146 that is rigidly supported at its ends by structure (not shown). The cross rail 146 is an aluminum extrusion that contains upper and lower parallel linear guides 148, 150, respectively, that are mounted on respective linear bearings 152, 154 within the cross rail 146. The cross rail 146 and linear guides and bearings are commercially available as a unit from 80/20, Inc. of Columbia, Ind. Both of the linear guides 172, 174 are rigidly fastened to one leg 155 of an L-bracket 156. The other leg 157 of the L-bracket 156 is rigidly fastened to the extrusion 78 of frame 16. A pair of power supply mounts 158 are rigidly fastened to the cross rail 146. Each of the power supply mounts 158 supports a power supply 160 that is operable to reciprocate, that is, extend and retract, a drive shaft 162. A distal end of each of the drive shafts 162 is pivotally connected to the leg 157 of the L-bracket 156 via pivot blocks 164. The power supply 160 may be any appropriate power supply that is effective to move the slitter and feed mechanisms 10, 10*a* longitudinally with respect to the cross rail 146, for example, a cylinder, a motor driven screw, etc. Thus, the power supplies 160 are operable to control the separation between the slitter and feed mechanisms 10, 10*a* on the cross rail 146. The power supplies 160 can be operated to position the slitter and feed mechanisms 10, 10*a* at different locations on the cross rail 146 to accommodate different widths of the soft goods being trimmed. The stationary table 12 has openings in which the support plates 15 of the slitter and feed mechanisms 10, 10*a* may move laterally.

The slitter and feed mechanisms 10, 10*a* are used to cut opposed side edges of a stack of soft goods, a portion of which is shown at 14. As will be appreciated, the stack of soft goods 14 is supported on an upper surface of the table 12 and normally extends substantially the full distance between the extrusions 78. In this example, the stack of soft goods 14 comprises a mattress cover comprising a top layer 166 of a ticking fabric material, an upper layer 168 of a fiber material, a middle layer 170 of a foam and a bottom layer 172 of a fabric backing material. More or fewer layers of soft goods may be utilized depending on the application of the stack of soft goods 14. The mattress cover is about 2-6 inches thick. In this application, the slitting wheels 26, 40 are mounted such that the cutting portion 95 (FIG. 3) on the upper wheel 26 contacts the cutting portion 96 (FIG. 2) on the lower wheel 40 about 0.75 inches above the support plate 15.

As the mattress cover 14 is fed by conveyors 22 along with compression apparatuses 110 onto the stationary table 12, its lateral edges are engaged by the conveyors 22 on each of the slitter and feed mechanisms 10, 10*a* and the mattress cover 14 is fed over the table 12 in a direction indicated by the arrow 174. Referring to FIG. 6B, the conveyor belt 23 is moving in a counterclockwise direction. As the stack of soft goods 14 is fed between the conveyor 22 and the compression assembly 110, the compression assembly 110 applies a compression force against the top of the stack of soft goods 14. The compression force is able to reduce the thickness of the stack of soft goods 14 to about two or more inches as the stack of soft goods is conveyed between the conveyor 22 and the compression assembly 110. Referring to FIG. 5, as the side edges of the soft goods 14 are compressed and conveyed by the conveyor 22 and compression assembly 110 of respective slitter and feed mechanisms 10, 10*a*, the edges pass between respective upper and lower slitting wheels 26, 40 that trim the edges to desired straight edges separated by a desired width.

The slitter and feed mechanism 10 is a relatively compact and inexpensive device for reliably compressing and cutting side edges of a stack of soft goods, for example, a mattress cover. The slitter and feed mechanism 10 utilizes a single motor 18 to drive both of the slitting wheels 26, 40 as well as conveyors 22. The utilization of a single motor to achieve conveying, compressing and cutting functions represents a substantial cost savings. The upper slitting wheel 26 has a biasing device 102, 105 that preloads the cutting portion 95 of the upper slitting wheel 26 against the cutting edge 96 of the lower slitting wheel 40. This preload more reliably maintains contact between the cutting portions 95, 96 such that a clean and consistent cutting action is provided. In addition, the outer bearing 54 is slightly offset with respect to the inner bearing 56. Therefore, the output spindle 52 and the lower slitting wheel 40 is slightly oblique with respect to the input spindle 28 of the upper slitting wheel 26. This oblique orientation of the respective slitting wheels 26, 40 together with the axial preload on the slitting wheels 26, 40 promotes a self-sharpening of the cutting portions 95, 96, thereby providing a more reliable cutting action over an extended period of time.

In use, referring to FIGS. 6A and 6B, the motor powers the first and second slitting wheels 26, 40 along with the conveyor 22 of each mechanism 10, 10*a* on opposed sides of the table 12. The mechanisms 10, 10*a* are positioned as shown in FIG. 6A prior to the soft goods 14 being introduced from a downstream region (to the left in FIG. 5). The compression assemblies are then lowered to their down positions shown in FIG. 6B so that they may cut and move the soft goods 14 downstream. When a desired length of soft goods have been cut a cross-cutter (not shown) cuts across the soft goods to finish the process.

Referring to FIG. 1, a slitter and feed mechanism or apparatus 10 is mounted on one side of a table 12 (see FIG. 5) and is used to trim one edge of soft goods 14. A conveyor(s) or any other mechanism (not shown) may be used to move the soft goods 14 as shown in FIGS. 5 and 6B past the slitter and feed mechanisms 10 and 10*a* onto table 12 (from left to right in FIG. 5).

FIGS. 7-11B illustrate an alternative embodiment of slitter and feed mechanism 10*b*. For purposes of simplicity, the same numerals will refer to parts which are identical to the embodiment described above and shown in FIGS. 1-6B.

Figure 7:
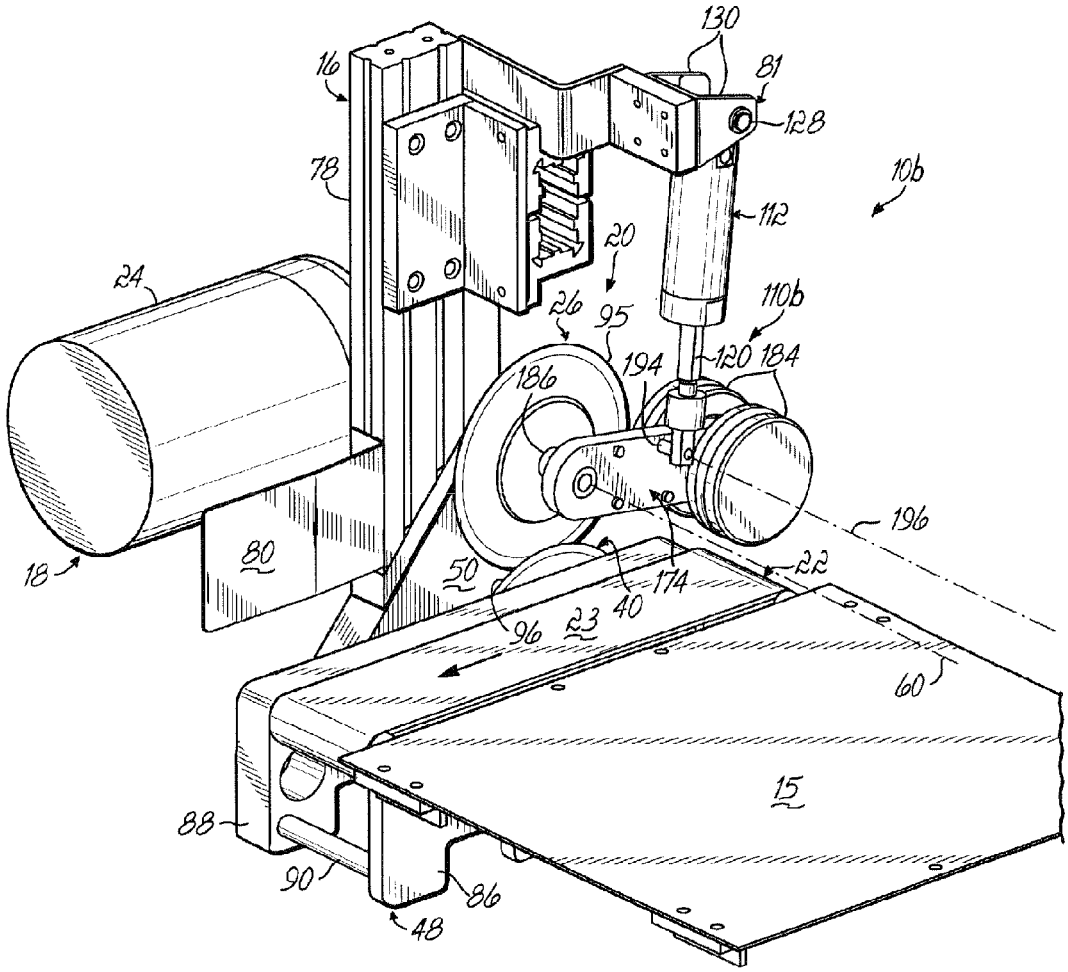
FIG. 7 is a perspective view of an alternative embodiment of slitter and feeder mechanism, which is used to trim one edge of soft goods.
Figure 11A:
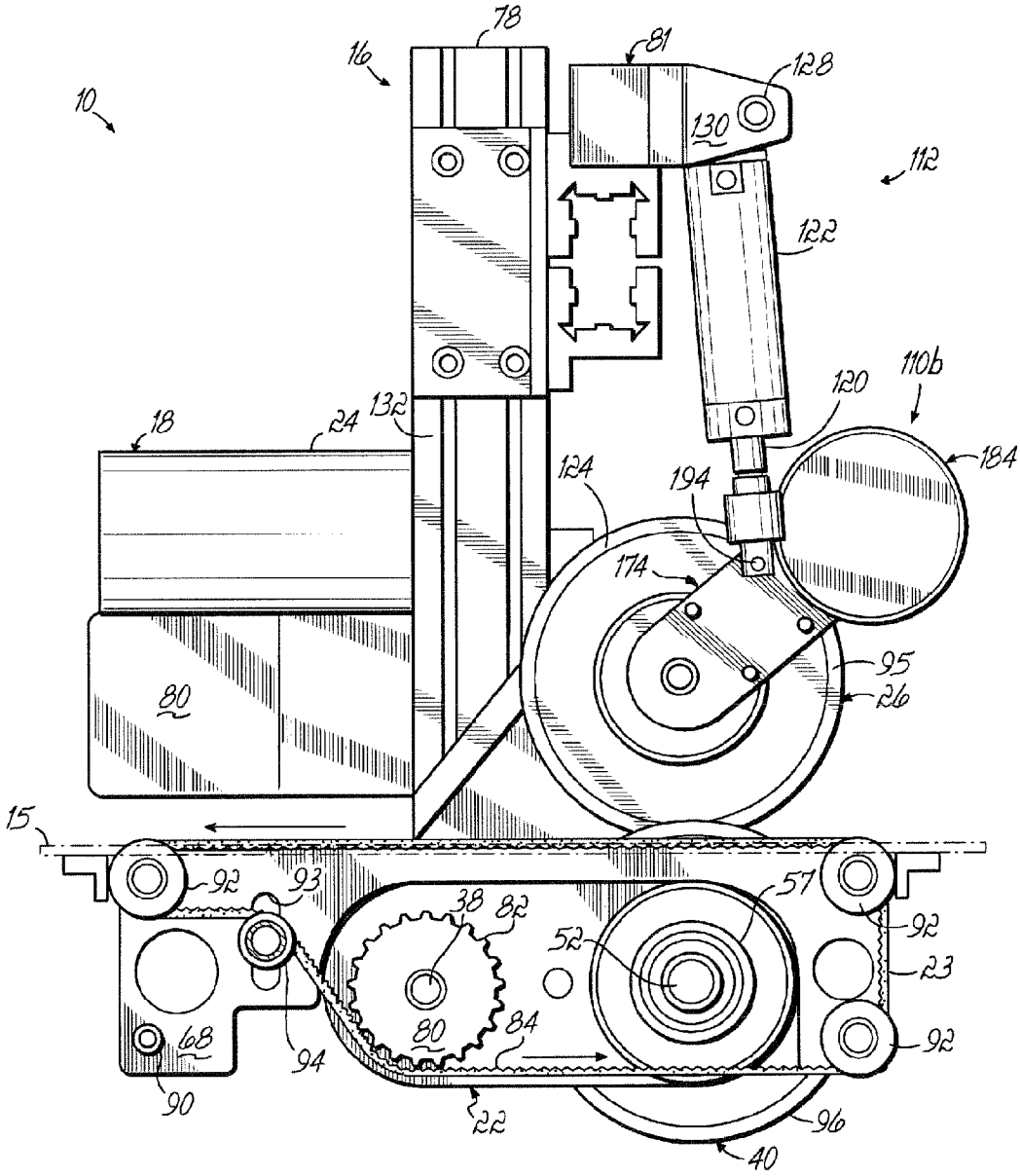
FIG. 11A is a front elevation view of the slitter and feed mechanism of FIG. 7 illustrating the compression assembly in a raised position before or after soft goods as passed under the compression assembly.
Figure 11B:
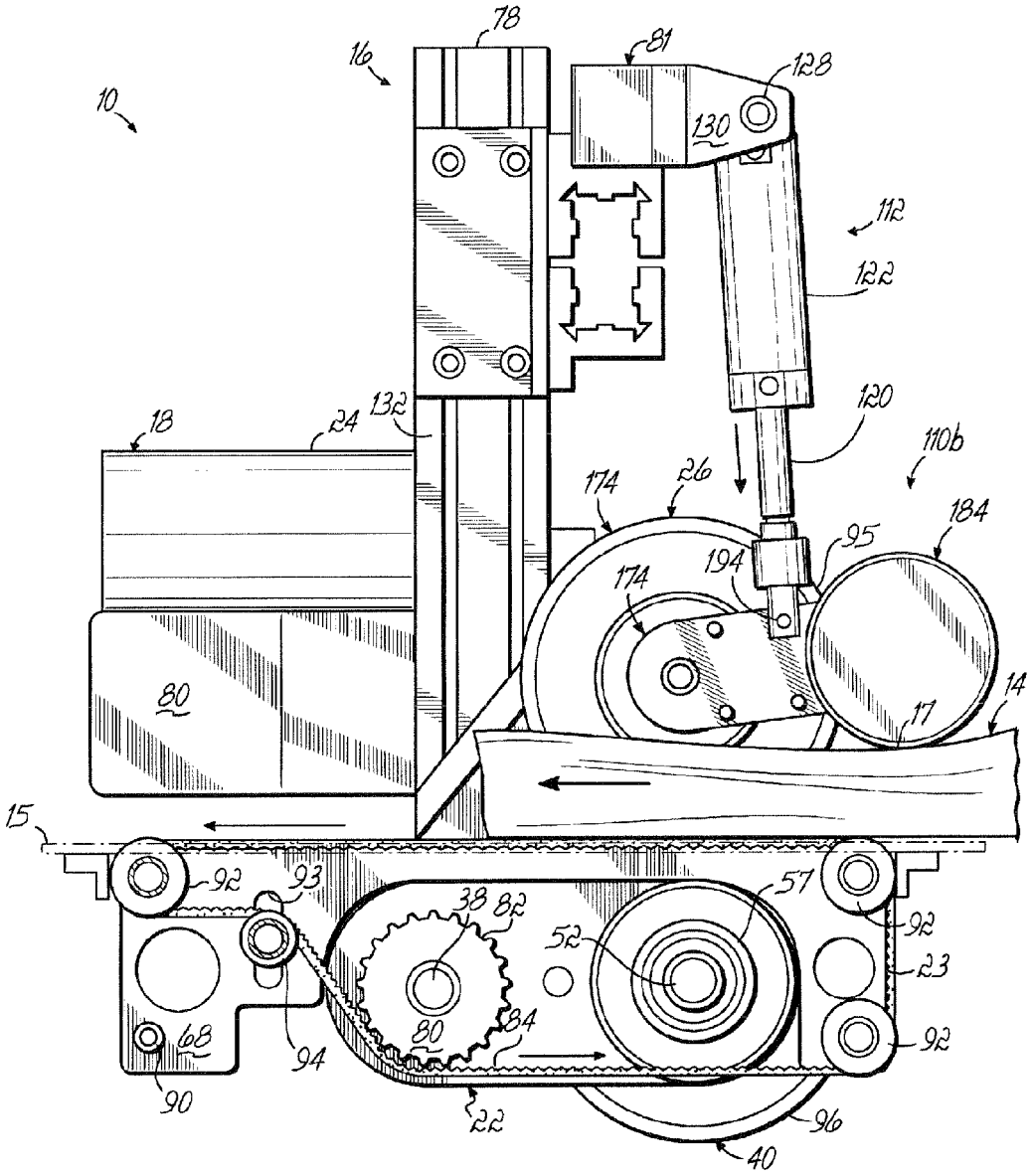
FIG. 11B is a front elevation view of the slitter and feed mechanism of FIG. 7 in a lowered position illustrating a resilient deflection of the compression assembly as soft goods are fed thereby.

Referring to FIG. 7, the slitter and feed mechanism 10*b* comprises the same components described above with respect to the first embodiment of slitter and feed mechanism 10, but has a different compression assembly 110*b* than the compression assembly 110 described above. In addition, bracket 132 shown in FIG. 1 is missing in the alternative embodiment. See FIG. 7. Referring to FIGS. 11A and 11B, the slitter and feed mechanism 10*b* is used to trim an edge of soft goods 14. As shown in FIG. 5, there is a second slitter and feed mechanism 10*c* which is a mirror image of, but otherwise identical to, the slitter and feed mechanism 10*b*.

Referring to FIG. 7, the compression assembly 110*b* of the slitter and feed mechanism 10*b* is disposed above the conveyor 22 and adapted to contact an upper surface of soft goods 14 and provide a downward compressive force on the soft goods 14 in order to keep the soft goods 14 moving downstream via conveyors 22 and aligned correctly. The compression assembly 110*b* comprises an actuator 112 which is pivotally connected to frame 16 via mounting bracket 81, a gear housing 174 pivotally mounted to actuator 112 and to input shaft extension portion 186 as described below, three gears 176, 178 and 180 inside the gear housing 174, as shown in FIG. 9, a drive shaft 182 and upstream rollers 184 operatively coupled to and rotatably driven by the drive shaft 178 for contacting an upper surface of the soft goods and moving the soft goods downstream with the conveyor driven by the motor.

Figure 8:
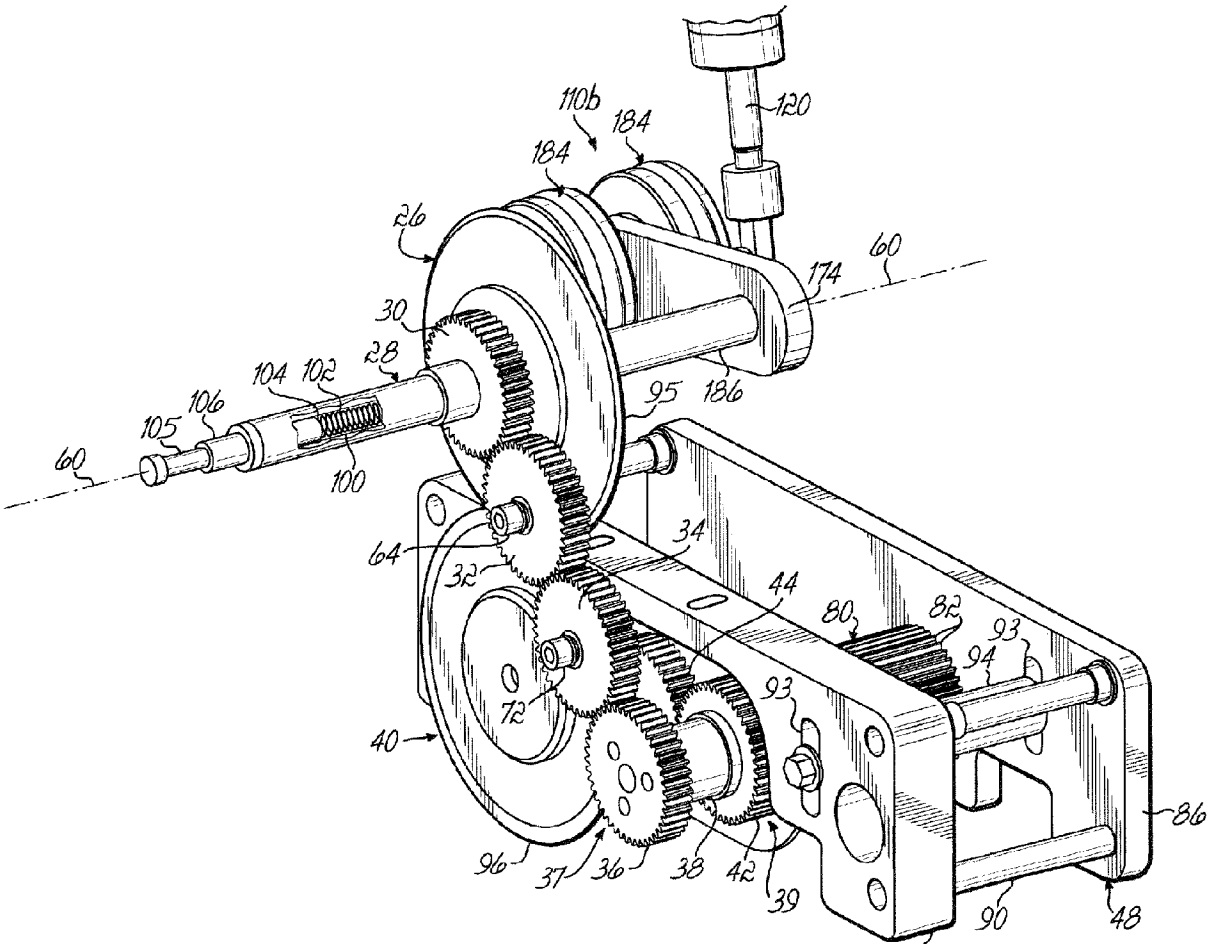
FIG. 8 is a partial perspective view of a slitter wheel power drive for the slitter and feed mechanism shown in FIG. 7.
Figure 9:
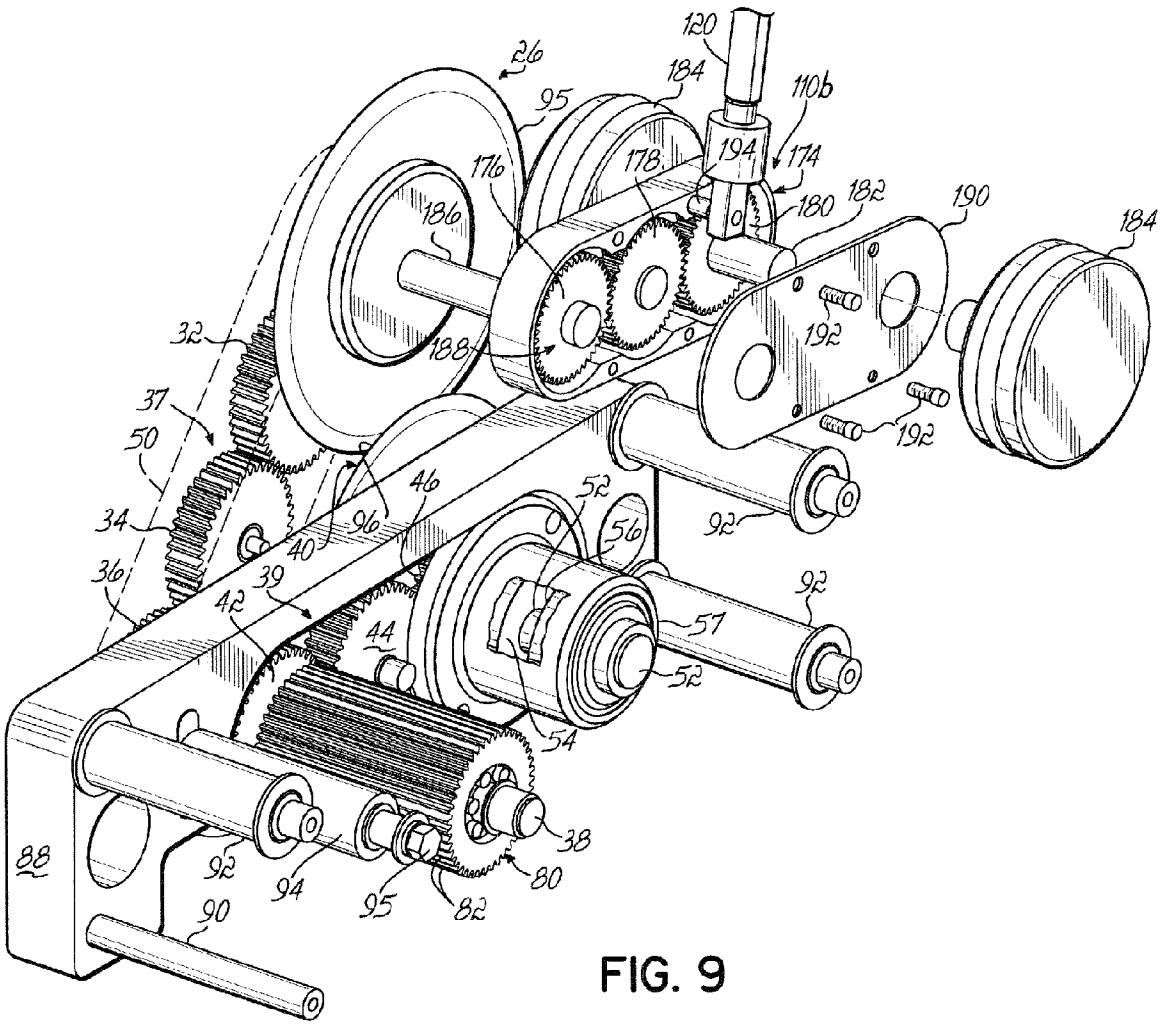
FIG. 9 is a partial perspective view of a conveyor drive of the slitter and feed mechanism shown in FIG. 7, the compression assembly being partially disassembled.
Figure 10:
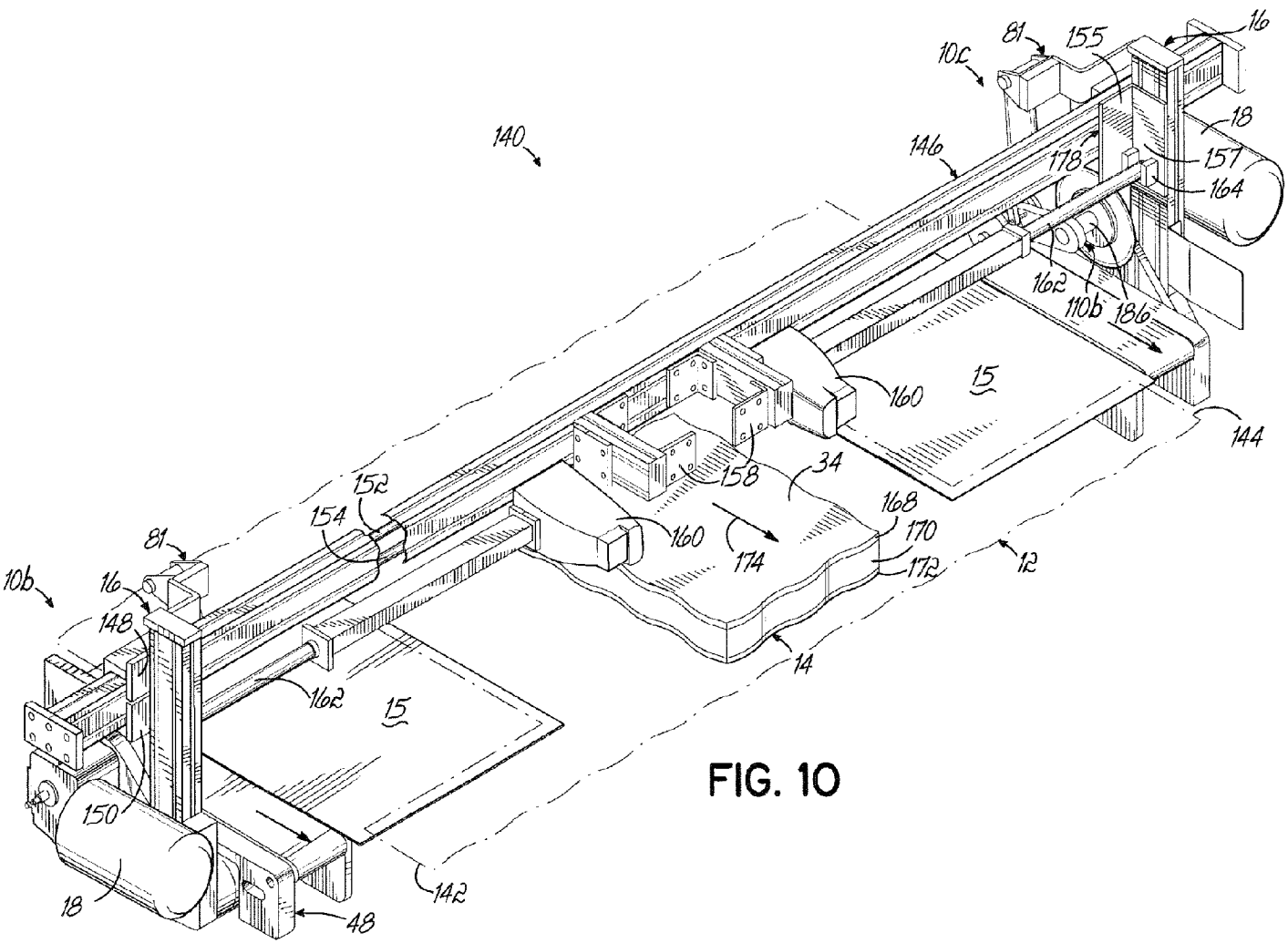
FIG. 10 is a partial perspective view of a machine that uses the slitter and feed mechanism of FIGS. 7-9.

As shown in FIGS. 7-9, a portion 186 of the input shaft or spindle 28 is rotatable about axis 60 like input shaft or spindle 28. This extension portion 186 of the input shaft or spindle 28 may be an extension or add on to input shaft or spindle 28 and extends inwardly from the first powered slitting wheel 26. This extension portion 186 of the input shaft or spindle 28 is operably coupled to an input gear 176 located inside the gear housing 174. The input gear 176 is engaged with a middle or intermediate gear 178 located inside the gear housing 174 as shown in FIG. 9. The last gear or output gear 180 of the three gear or drive train 188 is engaged with the middle or intermediate gear 178 as shown in FIG. 9. A drive shaft 182 is fixed to the output gear 180 and extends in opposite directions from the output gear 180 (only one side being shown in FIG. 9). A roller 184 is affixed or operatively coupled to the drive shaft 182 on each side of the gear housing 174. As shown in FIG. 9, the gear housing 174 has a removable cover 190 which is secured to the gear housing 174 with fasteners 192.

The compression assembly 110*b* is movable between a raised position shown in FIG. 11A and a lowered position shown in FIG. 11B. More particularly, the gear housing 174 is pivotal about axis 60 defined by the input shaft 28 and input shaft extension portion 186 as shown in FIG. 8. The actuator 112 is operatively coupled to the gear housing 174 via member 194 at a position between the rollers 184 and the pivot axis 60. The actuator 112 is controlled to raise and lower the rollers 184 by pivoting the gear housing 174 about pivot axis 60. In its lowered position shown in FIG. 11B, the rollers 184 of the compression assembly 110*b* contact an upper surface 17 of the soft goods 14 to provide a compressive force and help move the soft goods 14 downstream.

The actuator 112 of the compression assembly 110*b* comprises an air cylinder pressurized in a range of between approximately 20-25 psi. The actuator has a movable rod 120 which moves inside a cylinder 122. The rod 120 is pivotally joined to gear housing 174 via a member 194 which defines axis 196 so the gear housing 174 may pivot about axis 196. See FIG. 7. At its upper end, the actuator 112 is pivotally connected to a rod 128 extending between two ears 130 of mounting bracket 81.

In use, rotation of the input shaft or spindle 28 by the motor 18 rotates the extension portion 186 which rotates the input gear 176 of gear train 188 inside the gear housing 174. Rotation of input gear 176 causes rotation of gear 178 which causes rotation of output gear 178. Rotation of output gear 178 rotates drive shaft 182 which rotates the rollers 184. Thus, the rollers 184 rotate at the same speed in revolutions per minute as do the first and second powered slitting wheels 26, 40. Although one configuration of roller is illustrated, any other configuration or style of roller may be used.

The features described above can be incorporated into a panel cutter for a quilting machine, which is situated either in a separate cutting line or in-line with and downstream of a quilting machine. Such a quilting machine typically produces quilted mattress covers from a multi-layered web of material that forms the soft goods described above and illustrated in the figures. The panel cutter operates to transversely sever and crop panels from the web using transverse cutter tools provided for this purpose. In addition, slitters are provided in the panel cutter to trim selvedge edges from the quilted web or from individual quilted panels. While the features are described above as applied to slitters or longitudinal trimmers, these features can also be adapted for use in performing the transverse cut-off functions of the panel cutters, as most of the problems and properties found in slitting or trimming the edges of the quilted soft goods also can be found in cut-off operations performed on the same material.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, the slitting wheel 26 is biased against the slitting wheel 40; however, as will appreciated, in another embodiment, the slitting wheel 40 can be biased against the slitting wheel 26.

Therefore, the invention in its broadest aspects is not limited to the specific details shown and described. Consequently, departures may be made from the details described herein without departing from the spirit and scope of the claims which follow.

What is claimed is:

1. An apparatus for feeding and slitting a stack of compressible soft goods being supported on an upper surface of a table comprising:

a frame adapted to be mounted adjacent a table;

a motor;

a first powered slitting wheel rotatably driven by an input shaft rotatable by the motor;

a second powered slitting wheel rotatably driven by the motor and contacting the first slitting wheel to provide a cutting action;

a powered conveyor driven by the motor and adapted to be positioned adjacent the table and comprising a conveyor belt adapted to contact and support a lower surface along an edge of soft goods; and a compression assembly disposed above the conveyor and adapted to contact an upper surface along an edge of the soft goods, the compression assembly comprising an actuator operatively coupled to the frame, a gear housing operatively coupled to the actuator, gears inside the gear housing, an input gear of said gears being rotatable by the input shaft and rollers for contacting an upper surface of the soft goods and moving the soft goods, said rollers being operatively coupled to an output gear inside the gear housing.

2. The apparatus of claim 1 wherein the rollers are driven by a drive shaft rotatable by said output gear.

3. The apparatus of claim 1 wherein the compression assembly has at least one roller on each side of said gear housing.

4. The apparatus of claim 1 wherein the gear housing is pivotal about a pivot axis defined by said input shaft.

5. The apparatus of claim 4 wherein the actuator is operatively coupled to the gear housing at a position between the rollers and the pivot axis.

6. The apparatus of claim 1 wherein the rollers are resiliently movable in a generally vertical direction with respect to the conveyor.

7. The apparatus of claim 4 wherein one roller is on each side of the gear housing.

8. The apparatus of claim 1 wherein the actuator is pivotally secured to a mounting bracket secured to the frame.

9. The apparatus of claim 1 wherein the actuator is controlled to raise and lower the gear housing.

10. The apparatus of claim 1 wherein the actuator is an air cylinder.

11. The apparatus of claim 10 wherein the air cylinder is pressurized to approximately 20 to 25 psi.

12. An apparatus for feeding and slitting a stack of compressible soft goods being supported on an upper surface of a table comprising:

a frame adapted to be mounted adjacent one side of a table;

a motor supported by the frame for driving an input shaft;

a first powered slitting wheel rotatably driven by the input shaft;

a second powered slitting wheel rotatably driven via an output shaft, said output shaft being driven by a gear train powered by said motor, said second powered slitting wheel contacting the first slitting wheel to provide a cutting action;

a powered conveyor adapted to be positioned adjacent the table and comprising a conveyor belt adapted to contact and support a lower surface along an edge of soft goods; and a compression assembly disposed above the conveyor and adapted to contact an upper surface along the edge of the soft goods, the compression assembly comprising an actuator operatively coupled to the frame, a gear housing operatively coupled to the actuator, gears inside the gear housing, an input gear of said gears being rotatable by the input shaft and rollers for contacting an upper surface of the soft goods and moving the soft goods, said rollers being operatively coupled to an output gear inside the gear housing.

13. The apparatus of claim 12 wherein said rollers comprise rollers on each side of the gear housing.

14. The apparatus of claim 12 wherein the compression assembly is movable between a raised and lowered position.

15. The apparatus of claim 12 wherein said actuator is an air cylinder pressurized to approximately 20-25 psi.

16. The apparatus of claim 12 wherein said actuator is operatively coupled to said gear housing between an axis defined by said input shaft and said rollers.

17. An apparatus for feeding and slitting soft goods being supported on a table comprising:

a frame adapted to be mounted adjacent one side of a table;

a motor;

a first slitting wheel powered by the motor and rotatably supported by the frame;

a second slitting wheel powered by the motor and rotatably supported by the frame and contacting the first slitting wheel to provide a cutting action;

a conveyor powered by the motor and supported by the frame, the conveyor adapted to be positioned adjacent the table and comprising a conveyor belt adapted to contact and support a lower surface along an edge of the soft goods; and a compression assembly movable between a raised and lowered position, said compression assembly being disposed above the conveyor and adapted to contact an upper surface along the edge of the soft goods, the compression assembly comprising an actuator, a gear housing operatively coupled to the actuator, gears inside the gear housing, one of said gears being rotatable by the input shaft and operatively coupled to another gear for rotating rollers adapted to contact an upper surface of the soft goods and move the soft goods downstream.

18. The apparatus of claim 17 further comprising:

a biasing apparatus mechanically connected to the input shaft and applying a biasing force on the input shaft to push the first slitting wheel against the second slitting wheel with a desired biasing force;

a first axis of rotation defined by a rotation of the first slitting wheel and adapted to be substantially parallel to the upper surface of the table; and a second axis of rotation defined by a rotation of the second slitting wheel and adapted to be substantially parallel to the upper surface of the table, the second axis of rotation being oblique to the first axis of rotation.

19. An apparatus for feeding and slitting compressible soft goods comprising:

a stationary table having an upper surface adapted to support the soft goods;

a rail mounted above the stationary table and extending across a width of the stationary table;

a first slitter and feed mechanism mounted for sliding motion adjacent one end of the rail;

a first actuator supported by the rail having a reciprocal drive shaft pivotally connected to the first slitter and feed mechanism;

a second slitter and feed mechanism mounted for sliding motion adjacent an opposite end of the rail;

a second actuator supported by the rail and having a reciprocal drive shaft pivotally connected to the second slitter and feed mechanism, the first and second actuators being operable to move respective first and second slitter and feed mechanisms to different positions along the rail and the first and second slitter and feed mechanisms each further comprising a frame adapted to be mounted adjacent one side of the stationary table, a powered conveyor adapted to be positioned adjacent the stationary table, a compression assembly disposed above the conveyor and adapted to contact an upper surface along the edge of the compressible soft goods, the compression assembly comprising an actuator pivotally connected to the frame a gear housing connected to the actuator and at least one roller driven by a shaft rotatable by one of the gears inside the gear housing.

20. The apparatus of claim 19 wherein the rail further comprises:

a first linear bearing and a first linear guide supported for linear motion on the first linear bearing, the first linear guide supporting the first slitter and feed mechanism; and a second linear bearing and a second linear guide supported for linear motion on the second linear bearing, the second linear guide supporting the second slitter and feed mechanism.

21. A method of making quilted panels comprising:

quilting multi-layered soft goods at a quilting station;

feeding the quilted soft goods to a cutting apparatus;

at the cutting apparatus, supporting the quilted soft goods on a table having a frame, a motor mounted on the frame, a first slitting wheel powered by the motor and rotatably supported by the frame, a second slitting wheel powered by the motor and rotatably supported by the frame and contacting the first slitting wheel to provide a cutting action, a conveyor powered by the motor and supported by the frame, the conveyor adapted to be positioned adjacent the table and comprising a conveyor belt adapted to contact and support a lower surface along an edge of the soft goods; and a compression assembly disposed above the conveyor and adapted to contact an upper surface along the edge of the soft goods, the compression assembly comprising an actuator operatively coupled to the frame, a gear housing operatively coupled to the actuator, gears inside the gear housing, an input gear of said gears being rotatable by the input shaft and rollers for contacting an upper surface of the soft goods and moving the soft goods, said rollers being operatively coupled to an output gear inside the gear housing, and energizing the motor to operate the cutting apparatus to feed the quilted soft goods over the table and to slit the opposite edges from the quilted soft goods.

* * * * *